US005464166A

United States Patent [19]

Kirkpatrick, III; W. Mark et al.

[11] Patent Number: 5,464,166

[45] Date of Patent: Nov. 7, 1995

[54] METHOD AND APPARATUS FOR AUTOMATIC ROLL TRANSFER

[75] Inventors: W. Mark Kirkpatrick, III; Richard A. Hughbanks, both of Florence, S.C.

[73] Assignee: E. I. Du Pont de Nemours and Company, Wilmington, Del.

[21] Appl. No.: 296,832

[22] Filed: Aug. 26, 1994

[51] Int. Cl.[6] ..... B26D 1/62; B65H 19/20

[52] U.S. Cl. ..... 242/527.3; 83/305; 83/677

[58] Field of Search ..... 242/527.1, 527.3, 242/533.4, 533.6, 534; 83/305, 665, 677

[56] References Cited

U.S. PATENT DOCUMENTS

| | | | |
|---|---|---|---|
| 3,369,766 | 2/1968 | Herman | 242/527.1 |
| 3,794,255 | 2/1974 | Harmon et al. . | |
| 3,910,518 | 10/1975 | Yamaguchi et al. | 242/527.1 |
| 3,944,151 | 3/1976 | Lee et al. . | |
| 3,997,387 | 12/1976 | Yamaguchi et al. | 242/527.1 |
| 4,197,154 | 4/1980 | Pfaff, Jr. | 156/355 |
| 4,339,092 | 7/1982 | Benoy et al. | 242/527.1 |
| 4,415,610 | 11/1983 | Choinski | 427/372.2 |
| 4,529,141 | 7/1985 | McClenathan | 242/527.1 |
| 4,530,265 | 7/1985 | Lee et al. | 83/337 |
| 4,678,133 | 7/1987 | Suzuki | 242/527.3 |
| 5,190,232 | 3/1993 | Brandon et al. . | |

FOREIGN PATENT DOCUMENTS

| | | | |
|---|---|---|---|
| 2122071 | 11/1972 | Germany | 83/305 |

*Primary Examiner*—John P. Darling
*Attorney, Agent, or Firm*—Thomas H. Magee

[57] ABSTRACT

A method and apparatus for automatic roll transfer allows a film web winding onto a completed roll on a continuous film winder to be severed, and an incoming edge of the film web to be transferred onto a new core. A cylindrical housing having an external surface with an aperture extending therethrough is rotatably supported along a longitudinal axis thereof. A knife is held in a retracted position within the housing, the knife movably supported by the housing so as to allow the knife to move along a direction orthogonal to the longitudinal axis from the retracted position through the aperture to a cutting position. The apparatus includes elements to rotate the housing, to position the rotating housing adjacent to the film web, and to subsequently release the knife, thereby causing the knife to move from the retracted position to the cutting position and sever the film web. The incoming edge of the film web is transferred onto the core by utilizing a static attraction between the core and the film web, the static attraction being produced by a static generator positioned adjacent to the core.

21 Claims, 11 Drawing Sheets

METHOD AND APPARATUS FOR AUTOMATIC ROLL TRANSFER

FIELD OF THE INVENTION

The present invention pertains to a method and apparatus for automatic roll transfer wherein a film web winding onto a completed film roll on a continuous film winder is severed, and an incoming edge of the web is transferred onto a new core. In particular, the invention is directed to a rotary knife apparatus which cuts the moving web without retarding web speed and, thereby, facilitates film laydown on the core.

BACKGROUND OF THE INVENTION

U.S. Pat. No. 3,944,151 discloses an apparatus for automatically splicing an expiring web onto a new web roll by successively firing a bumper roll and a knife roll, respectively, to perform either an oversplice or an undersplice. The bumper roll serves to bring the expiring web in contact with the new web roll while the knife roll then severs the trailing edge of the old web.

U.S. Pat. No. 4,530,265 discloses a rotary cutoff knife assembly wherein a support is mounted on a frame for rotary motion around a first axis, and a knife blade is mounted on the support for rotary motion around a second axis parallel to and spaced from the first axis. Means are provided for concomitantly driving the support: and the blade around the axes such that the blade moves from a first position remote from the web to a second position at which it engages and severs the web and then back to the first position.

SUMMARY OF THE INVENTION

The present invention comprises a method and apparatus for automatic roll transfer wherein a film web winding onto a completed roll on a continuous film winder is severed, and an incoming edge of the film web is transferred onto a new core. A cylindrical housing having an external surface with an aperture extending therethrough is rotatably supported along a longitudinal axis thereof. A knife is held in a retracted position within the housing, the knife movably supported by the housing so as to allow the knife to move along a direction orthogonal to the longitudinal axis from the retracted position through the aperture to a cutting position. Means are provided to rotate the housing, to position the rotating housing adjacent to the film web, and to subsequently release the knife, thereby causing the knife to move from the retracted position to the cutting position and sever the film web. The incoming edge of the film web is transferred onto the core by means of a static attraction between the core and the film web, the static attraction being produced by a static generator positioned adjacent to the core.

BRIEF DESCRIPTION OF THE DRAWINGS

FIG. 11 B is the view shown in FIG. 11A illustrating the position of the knife relative to the external surface of the cylindrical housing after the trigger has been activated.

DETAILED DESCRIPTION OF THE PREFERRED EMBODIMENT

Figure 1A:
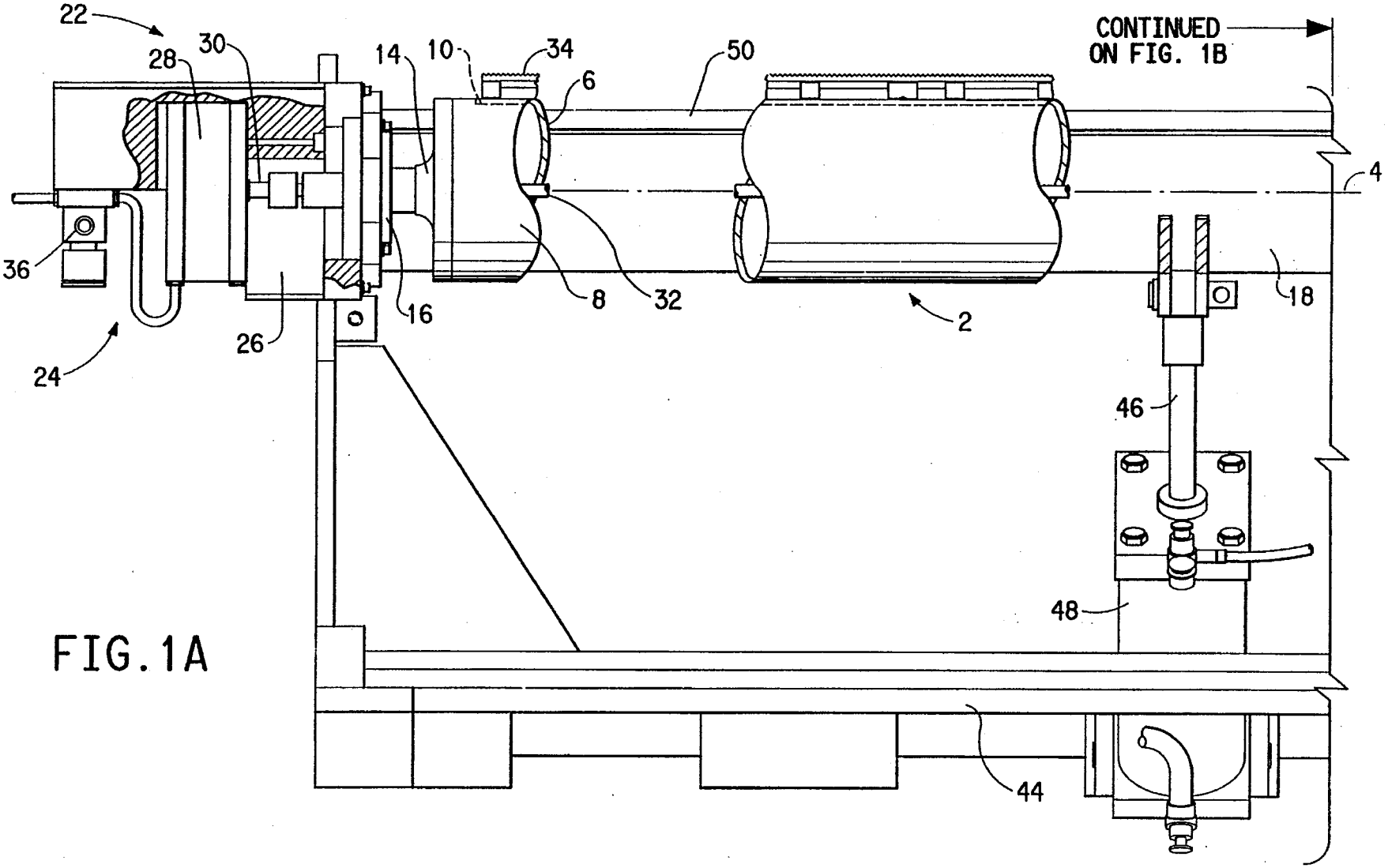
FIGS. 1A and 1B are elevated views of a rotary knife apparatus illustrating means for rotating a cylindrical housing and means for lifting the rotating cylindrical housing.
Figure 1B:
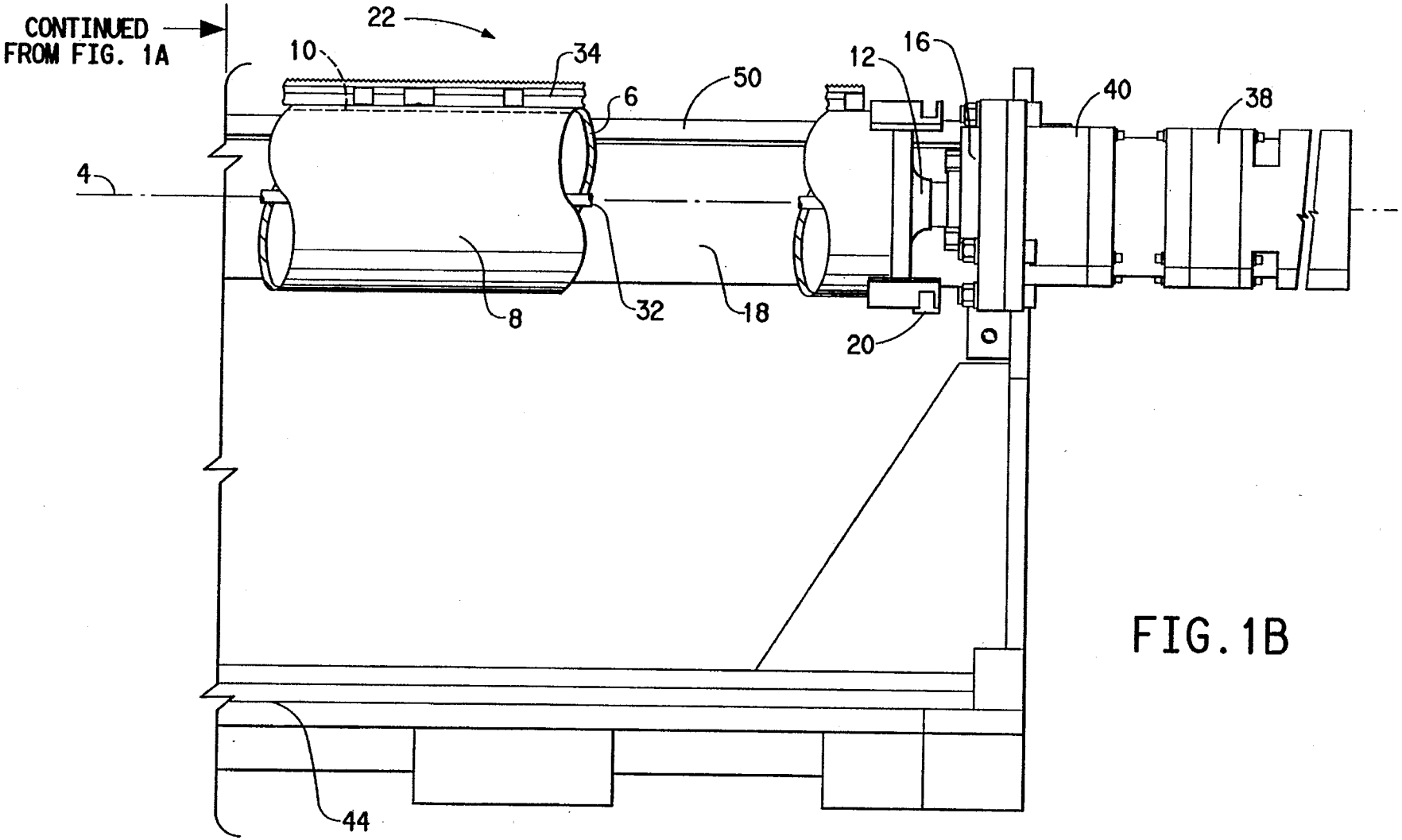

FIGS. 1A and 1B show a rotary knife apparatus 22 comprising a cylindrical housing 2 rotatably supported along a longitudinal axis 4 thereof. The cylindrical housing 2 comprises a cylindrical shell 6 having an external surface 8 with an aperture 10 extending therethrough. The cylindrical shell 6 is attached at each end thereof to a trunnion 12 and 14. The trunnions 12 and 14 are rotatably supported by two bearings 16 affixed, respectively, to opposite ends of a support beam 18. A flag 20 is mounted on the shell 6 adjacent to one trunnion 12. A trigger block 26 is affixed to the support beam 18 adjacent to the other trunnion 14 opposite the one trunnion 12. The trigger block 26 supports a trigger mechanism 24 comprising a trigger cylinder 28 having a trigger piston 30 disposed adjacent to a trigger shaft 32. The trigger piston 30 axially pushes the trigger shaft 32 to release a knife 34 movably supported by the cylindrical housing 2. The trigger cylinder 28 is activated by a trigger valve 36 coupled to a proximity sensor 112 for receiving a release signal. The housing 2 is rotated by means of a programmable motor 38 connected to the trunnion 12. The motor is supported by a motor mount 40 affixed to one end of the support beam 18. The support beam 18 is attached to arms 42 pivotally mounted on a support frame 44 and to a lifting piston 46 of a lifting cylinder 48 affixed to the support frame 44. A static generator 50 is affixed to the support beam 18.

Figure 2:
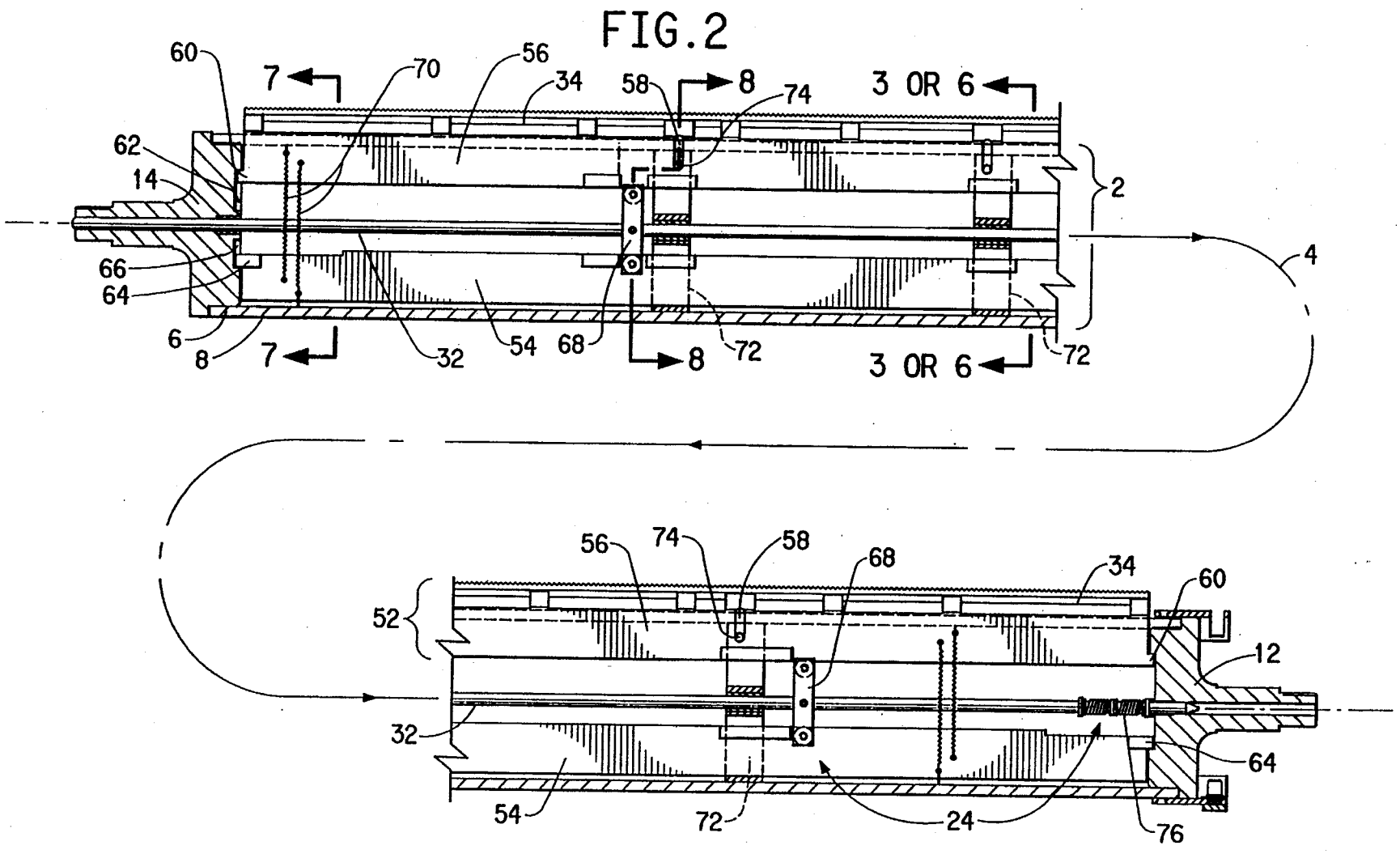
FIG. 2 is a cross-sectional view of the cylindrical housing illustrating a knife mount, a knife, a counterweight and a trigger in a cutting position.

FIG. 2 shows the cylindrical housing 2 containing a knife mount 56, a counterweight 54 and two H-shaped triggers 68. The knife 34 is attached to the knife mount 56 which has guideholes 58 therethrough. The knife mount 56 is positioned in an upper half of the cylindrical shell 6 along the direction of the longitudinal axis 4. The knife mount 56 has tabs 60 at each end thereof that project, respectively, into slots 62 disposed in the adjacent trunnion 12 and 14, and allow the knife mount 56 to move from a retracted position adjacent the longitudinal axis 4 in a direction away from the longitudinal axis 4 to the cutting position. The counterweight 54 is positioned in the lower half of the cylindrical shell 6 opposite the upper half along the directional of the longitudinal axis 4. The counterweight 54 has projections 64 at each end thereof that project, respectively into grooves 66 disposed in the adjacent trunnion 12 and 14 along the same direction as the slots 62, and allow the counterweight 54 to move from a retracted position adjacent the longitudinal axis 4 away from the longitudinal axis 4 toward the shell 6 in a direction opposite to movement of the knife 34. The trigger shaft 32 is moveably supported by the trunnions 12 and 14 long the longitudinal axis 4, and is connected to the H-shaped triggers 68. The H-shaped triggers 68 hold the knife mount 56 and the counterweight 54 in the retracted position until the trigger mechanism 24 is released in response to the release signal. Upon release, centrifugal force exerted on the knife mount 56 and the counterweight 54 due to rotation of the housing 2 causes movement of the knife mount 56 and the counterweight 54 from the retracted position to the cutting position. The counterweight 54 and knife mount 56 are sized and positioned within the housing 2 to maintain a stable mechanical moment within the rotating housing 2 when the knife mount 56 and the counterweight 54 move from the retracted position to the cutting position. The knife mount 56 and the counterweight 54 are connected to springs 70 attached to the cylindrical shell 6. The springs 70 have a spring constant sufficient for pulling the knife mount 56 and counterweight 54 back to the retracted position when the housing 2 is not rotating. When the trigger mechanism 24 releases the knife mount 56 and the counterweight 54, the spring constant is overcome by centrifugal force exerted on the knife mount 56 and the counterweight 54 due to rotation of the housing 2, thereby allowing the knife mount 56 and counterweight 54 to move to the cutting position. The cylindrical shell 6 is divided by rigid partitions 72 perpendicular to the longitudinal axis 4 which impart necessary structural strength to the cylindrical shell 6 during rotation of the housing 2 and movement of the knife mount 56 and the counterweight 54. The knife mount 56 is secured by restraining braces 74 positioned within the guideholes 58 and anchored to the partitions 72. The trigger shaft 32 is connected to a compression spring 76 adjacent to the one trunnion 12 for returning the trigger shaft 32 to the retracted position, whereby the triggers 68 are engaged to hold the knife mount 56 and the counterweight 54 in the retracted position.

Figure 3:
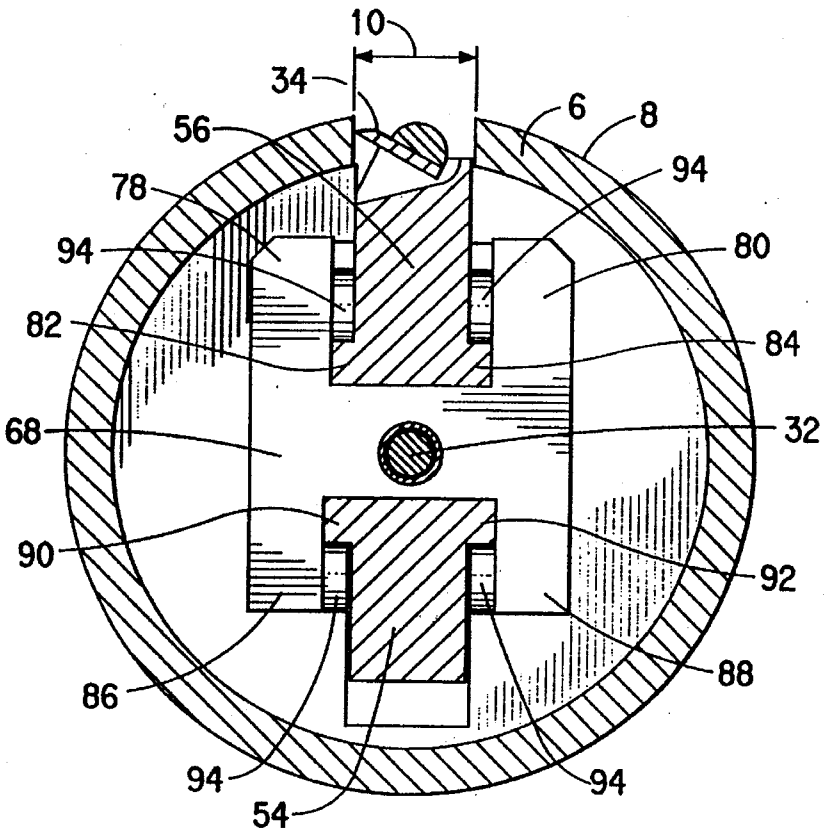
FIG. 3 is a cross-sectional view taken along line 3—3 of FIG. 2 illustrating the knife mount and the counterweight held in a retracted position by the trigger.

FIG. 3 shows the cylindrical shell 6 having the aperture 10 therethrough, the knife mount 56, the counterweight 54, and the trigger shaft 32 with the trigger 68 in an engaged position holding the knife mount 56 and the counterweight 54 in the retracted position. The H-shaped trigger 68 has two upward legs 78 and 80 disposed in surrounding relationship to knife wings 82 and 84 extending from opposite sides of the knife mount 56, and has two downward legs 86 and 88 disposed in surrounding relationship to counterweight wings 90 and 92 extending from opposite sides of the counterweight 54. Each of the legs 78, 80, 86 and 88 has a trigger roller 94 attached on the inside thereof and positioned so as to contact, respectively, the adjacent wing to hold the knife mount 56 and the counterweight 54 in the retracted position.

Figure 4:
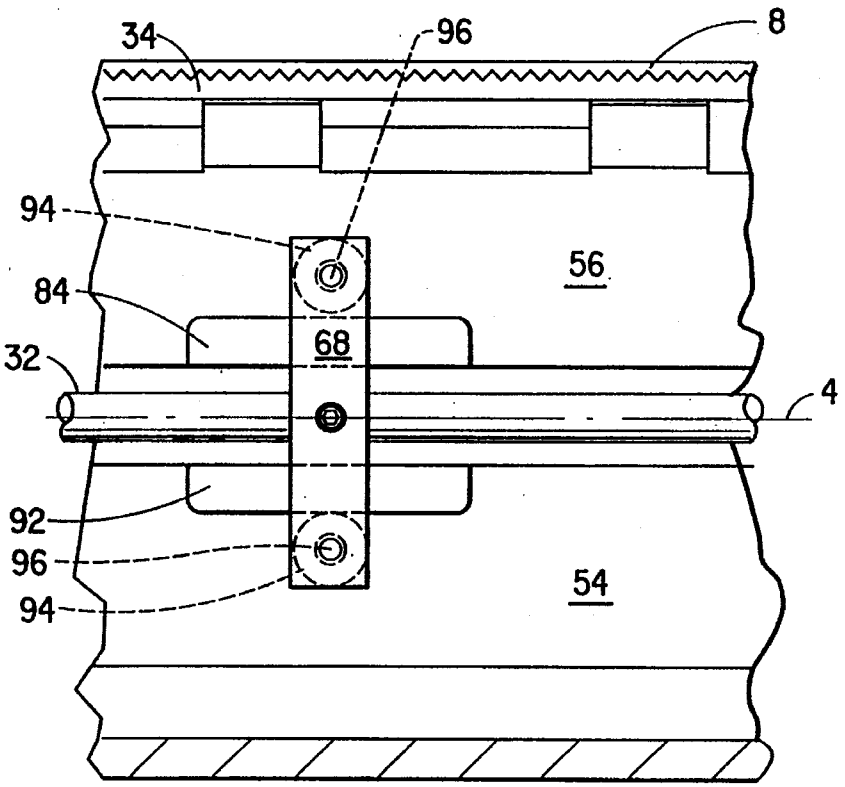
FIG. 4 is an enlarged partial view of the cylindrical housing cross-section shown in FIG. 2 illustrating the trigger in the retracted position.

FIG. 4 shows the trigger shaft 32, the knife mount 56, and the counterweight 54 in the retracted position with the trigger 68 in the engaged position, and the knife 34 held within the housing 2. The trigger rollers 94 are positioned to contact an adjacent knife wing 84 extending from the knife mount 56 and an adjacent counterweight wing 92 extending from the counterweight 54, respectively, and hold the knife mount 56 and the counterweight 54 in the retracted position.

Figure 5:
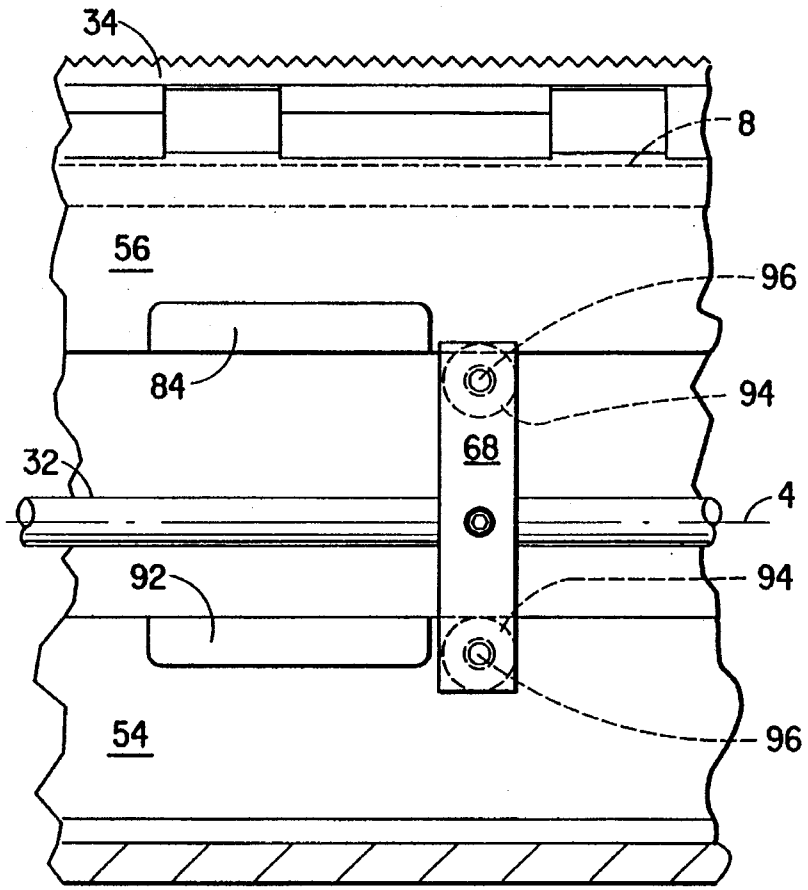
FIG. 5 is the view shown in FIG. 4 illustrating the trigger in the cutting position.

FIG. 5 shows the counterweight 54 and the knife mount 56 in the cutting position with the knife 34 extending past the surface 8 of the cylindrical shell 6 after the trigger 68 has been released by axial movement of the trigger shaft 32 such that the trigger rollers 94 have rolled off the adjacent wings 84, 92.

Figure 6:
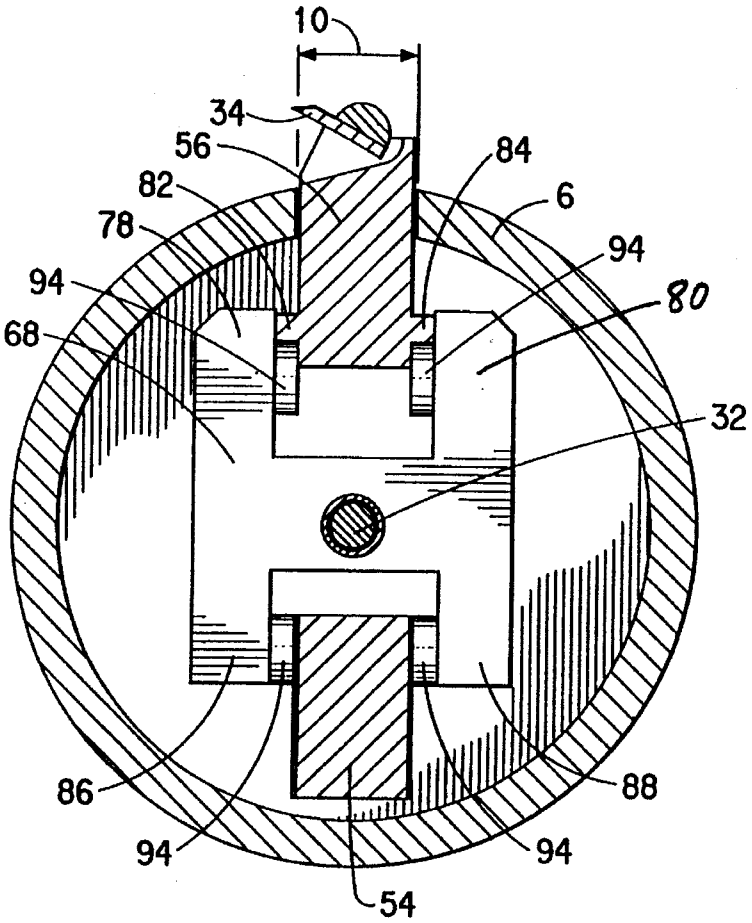
FIG. 6 is a cross-sectional view taken along line 6—6 of FIG. 2 illustrating the knife mount and the counterweight in the cutting position.

FIG. 6 shows the knife mount 56 and the counterweight 54 in the cutting position with the knife 34 extending through the aperture 10 in the cylindrical shell 6.

Figure 7:
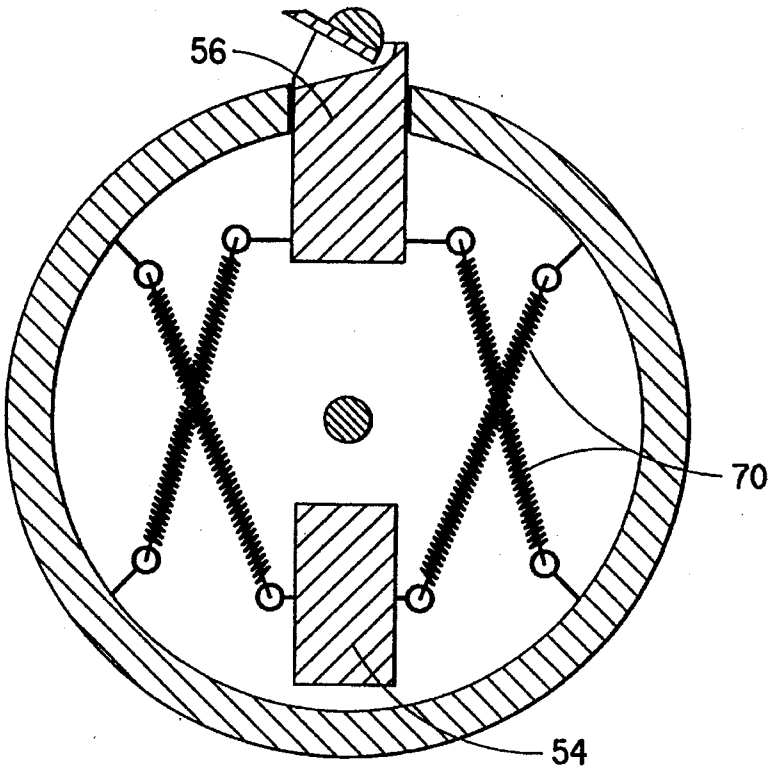
FIG. 7 is a cross-sectional view taken along line 7—7 of FIG. 2 illustrating springs for pulling the knife mount and the counterweight into the retracted position.

FIG. 7 shows the knife mount 56 and the counterweight 54 connected to springs 70 which are attached to the cylindrical shell 6.

Figure 8:
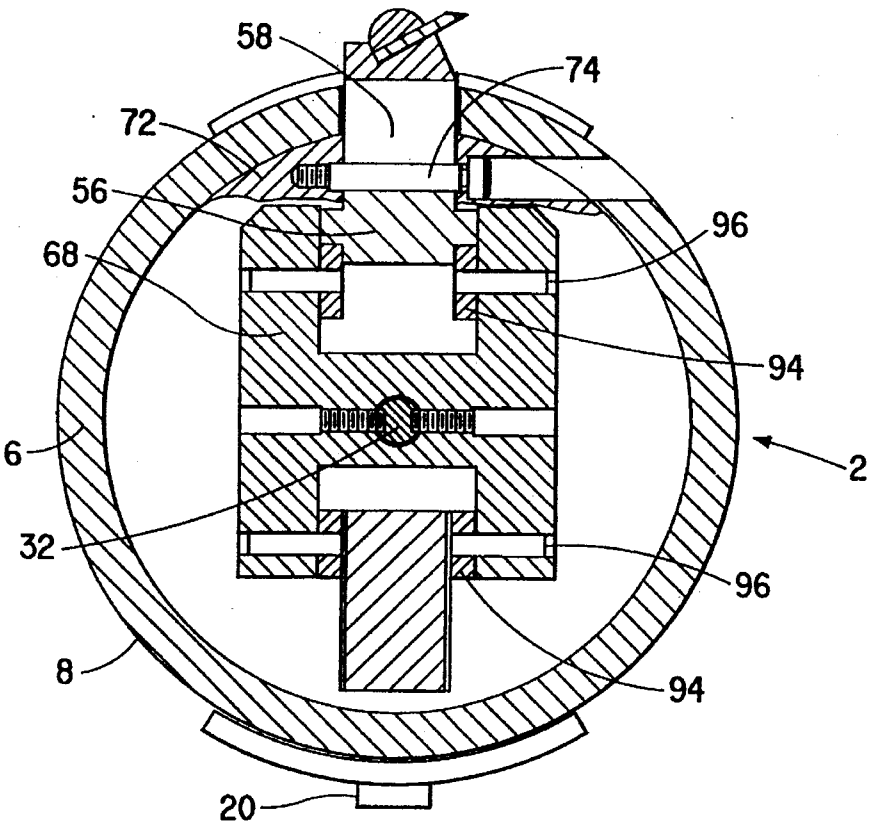
FIG. 8 is a cross-sectional view of the housing taken along line 8—8 of FIG. 2.

FIG. 8 shows the cylindrical shell 6 containing one trigger 68 attached to the trigger shaft 32. The trigger rollers 94 are rotatably supported by axles 96 attached to the inside of the trigger legs 78, 80, 86 and 88. The brace 74 is disposed through the guidehole 58 of the knife mount with opposing ends of the brace 74 anchored in the partition 72. The flag 20 is affixed to the external surface 8 of the cylindrical housing 2.

Figure 9:
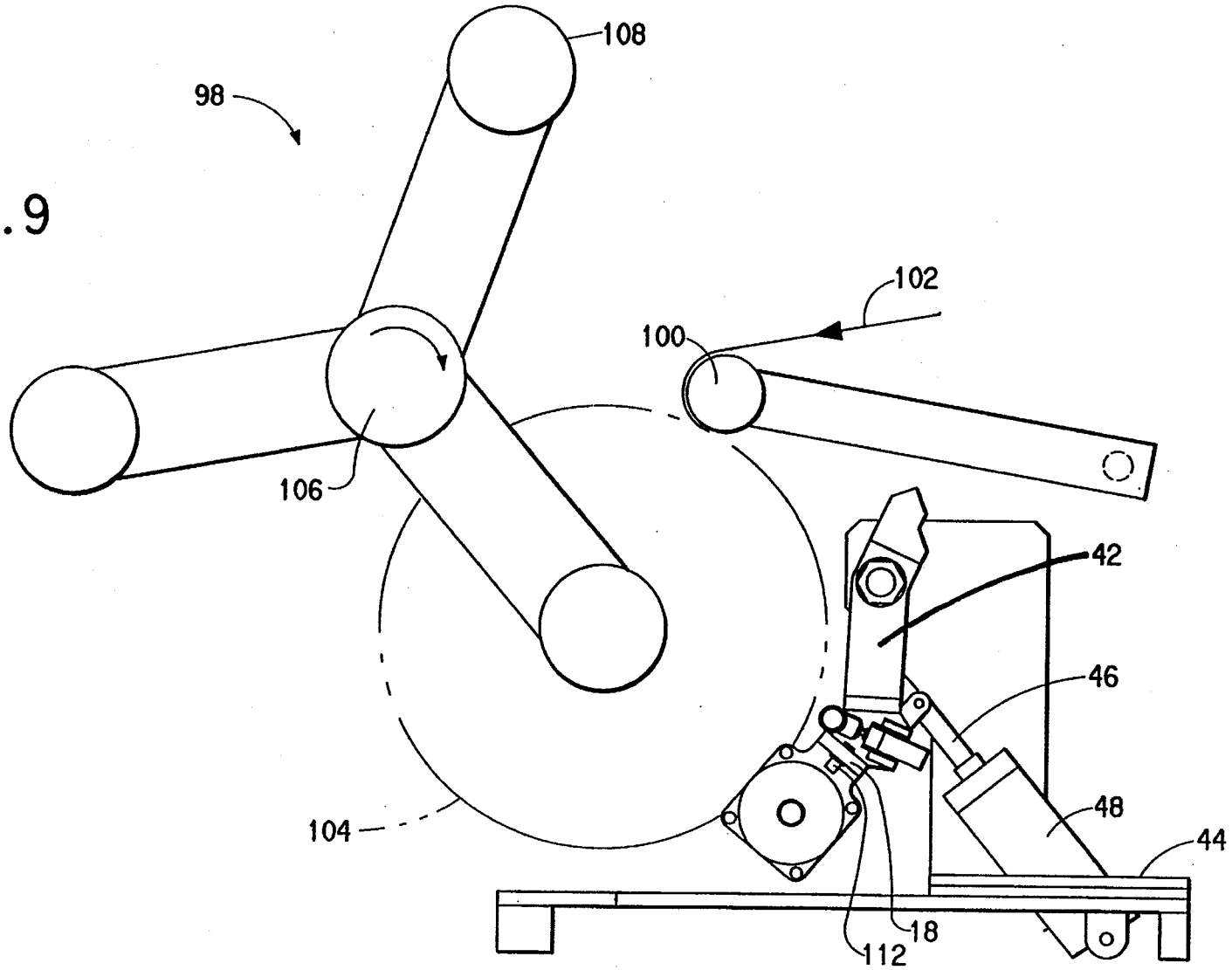
FIG. 9 is an elevation view of a continuous film winder illustrating a lay-on roll for pressing a moving film web onto a film roll.

FIG. 9 shows a continuous film winder 98 with a lay-on roll 100 pressing a moving film web 102 onto a film roll 104. The rotary knife apparatus 22 is in a rest position.

Figure 10:
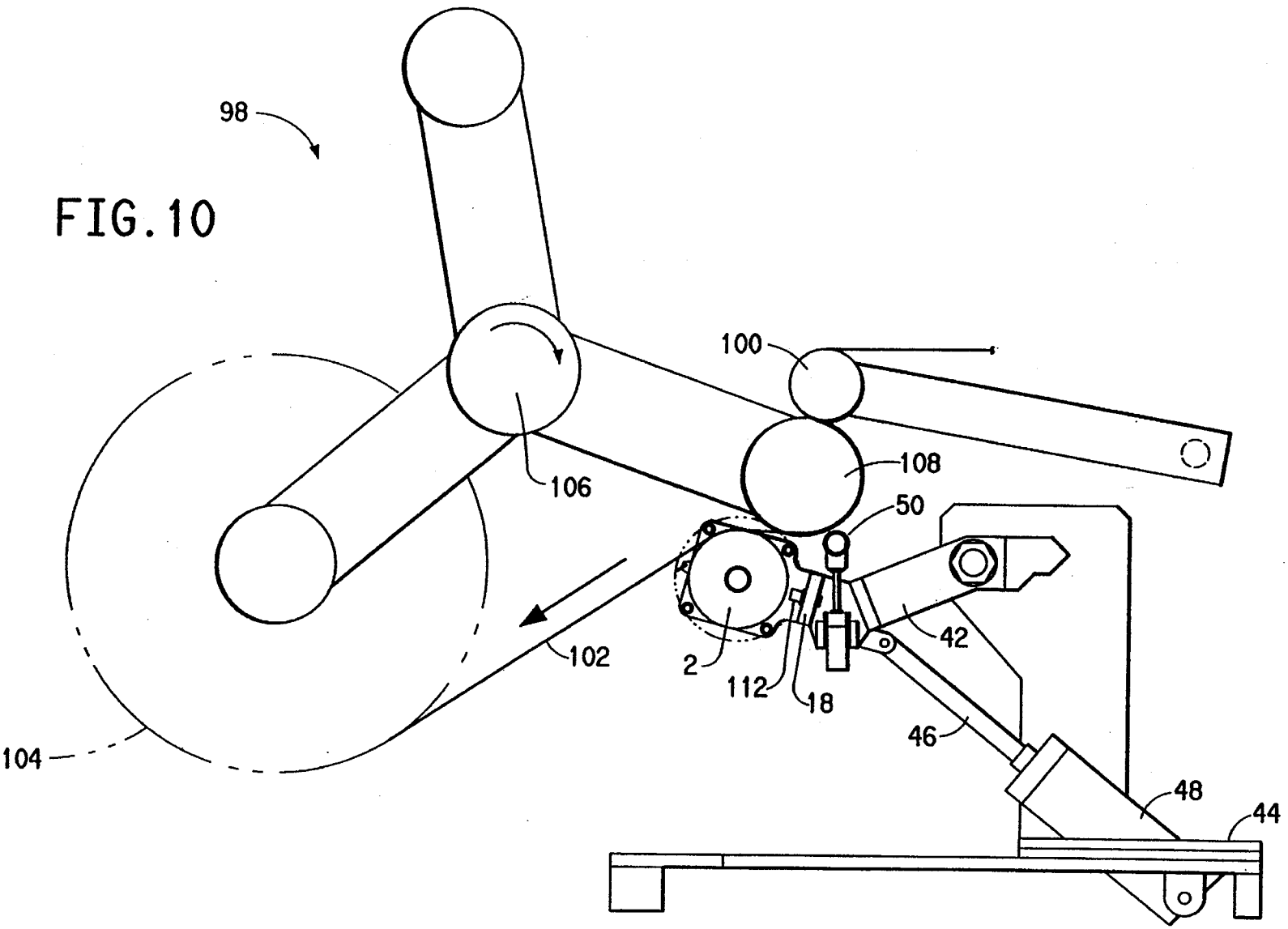
FIG. 10 is an elevation view illustrating the continuous film winder during roll transfer showing the lay-on roll pressing the film web into contact with a new core and the rotary knife apparatus positioned between the core and the film roll prior to severing the film web.

FIG. 10 shows the continuous film winder 98 during roll transfer with the film web 102 winding onto the film roll 104 after rotation of a turret 106 to provide a new core 108. The lay-on roll 100 presses the film web 102 onto the new core 108 when the rotary knife apparatus 22 is in a raised position. The static generator 50 is positioned adjacent to the core 108, and the rotating cylindrical housing 2 is positioned adjacent to the film web between the core 108 and the film roll 104. The proximity sensor 112 is positioned such that the flag 20 passes along a path adjacent the sensor 112 when the cylindrical shell 6 is rotated. The proximity sensor 112 senses the position and speed of the rotating shell 6 by means of interaction between the sensor 112 and the flag 20. When the speed of the cylindrical shell 6 is appropriate for severing the film web 102, the sensor 112 generates a release signal in response to the flag 20 passing adjacent the sensor 112 and transmits the release signal to the trigger mechanism 24. This signal releases the triggers 68 causing the knife 34 to move from a retracted position to a cutting position, thereby severing the film web 102.

Figure 11A:
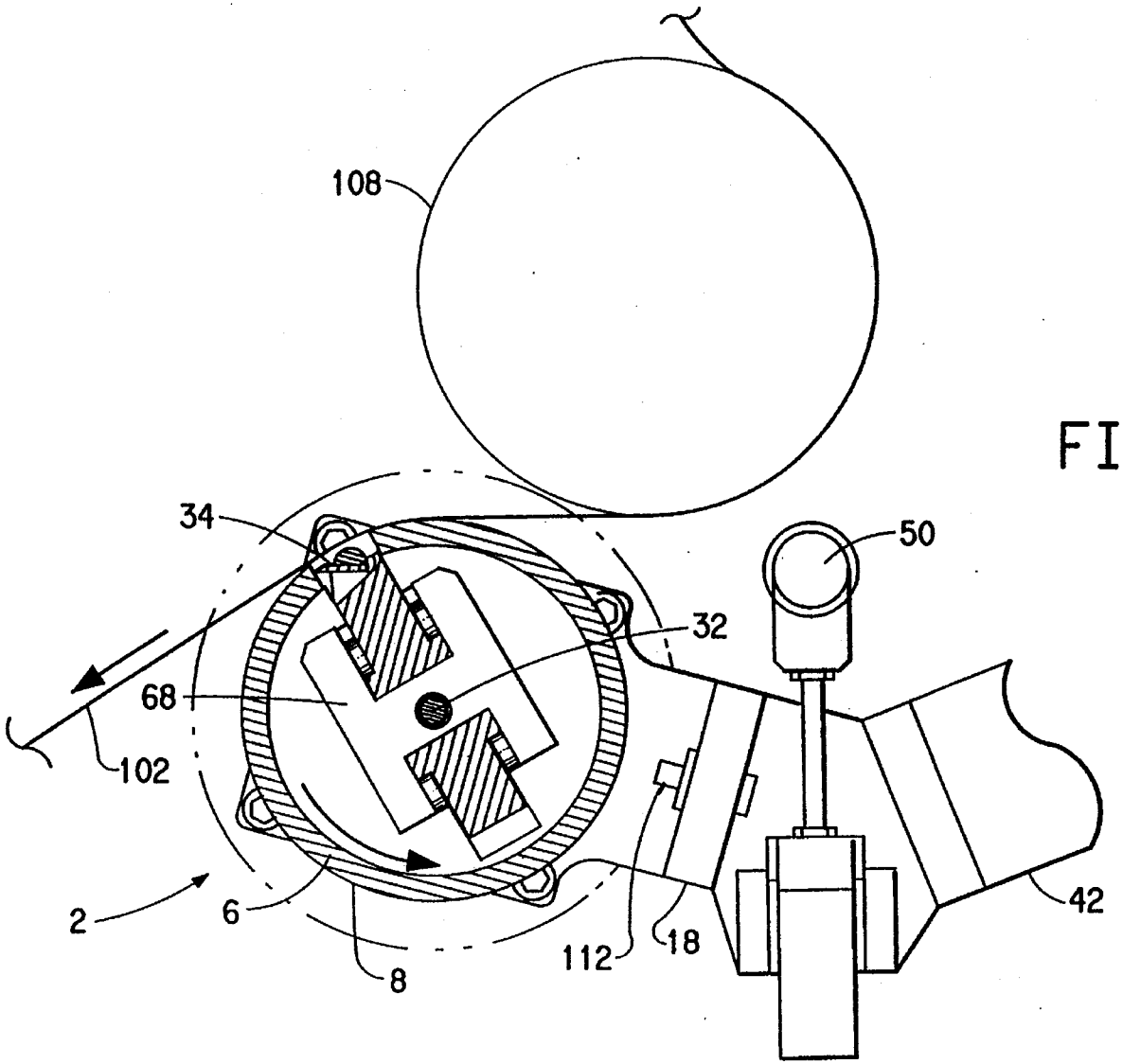
FIG. 11 A is an elevation view illustrating a static generator bar positioned adjacent to the core and the knife in the retracted position within the cylindrical housing prior to severing the film web.
FIG. 11C is the view shown in FIG. 11A after further rotation of the cylindrical housing illustrating the knife in the cutting position prior to severing the film web.

FIGS. 11A, lib and 11C show the relative position of the knife 34, the core 108 and the static generator 50 as the knife 34 moves from the retracted position to the cutting position to sever the film web 102. The flag 20 is positioned on the cylindrical housing 2 such that, during rotation of the cylindrical housing 2, the flag 20 passes adjacent the sensor 112 when the aperture 10 of the housing 6 has just rotated away from the film web 102.

The automatic roll transfer method of the present invention transfers winding of the film web 102, being wound on the film roll 104 on the winder 98, to the new core 108 by rotating the turret 106 from a first position, as shown in FIG. 9, to a second position, as shown in FIG. 10, in order to advance a core 108. The lay-on roll 100 presses the film web 102 against the core 108 while the film web 102 continues winding on the film roll 104.

The motor 38 of the rotary knife apparatus 22 then begins rotating the cylindrical housing 2, wherein the knife mount 56 and the counterweight 54 supported by the cylindrical housing 2 are in a retracted position. The motor 38 ramps up rotation speed to achieve a preferred maximum linear surface speed of the cylindrical housing 2 based on the speed at which the film web 102 is moving and the thickness of the film web 102. The rotational speed of the cylindrical housing 2 can be varied widely between a minimum rotational speed, where the centrifugal force acting on the knife mount 56 is sufficient to move the knife 34 to the cutting position, to a maximum rotational speed based on the mechanical limits of the motor 38 and the cylindrical housing 2. It is preferred to rotate the cylindrical housing 2 at a higher linear surface speed than the speed of the film web 102 to be severed. The preferred ratio of the linear surface speed of the cylindrical housing 2 to the speed of the film web 102 is determined experimentally based on mechanical properties and thickness of the film web 102. In a preferred embodiment, the maximum linear speed of the cylindrical housing 2 is typically 25% greater than the speed of the film web 102.

Figure 11B:
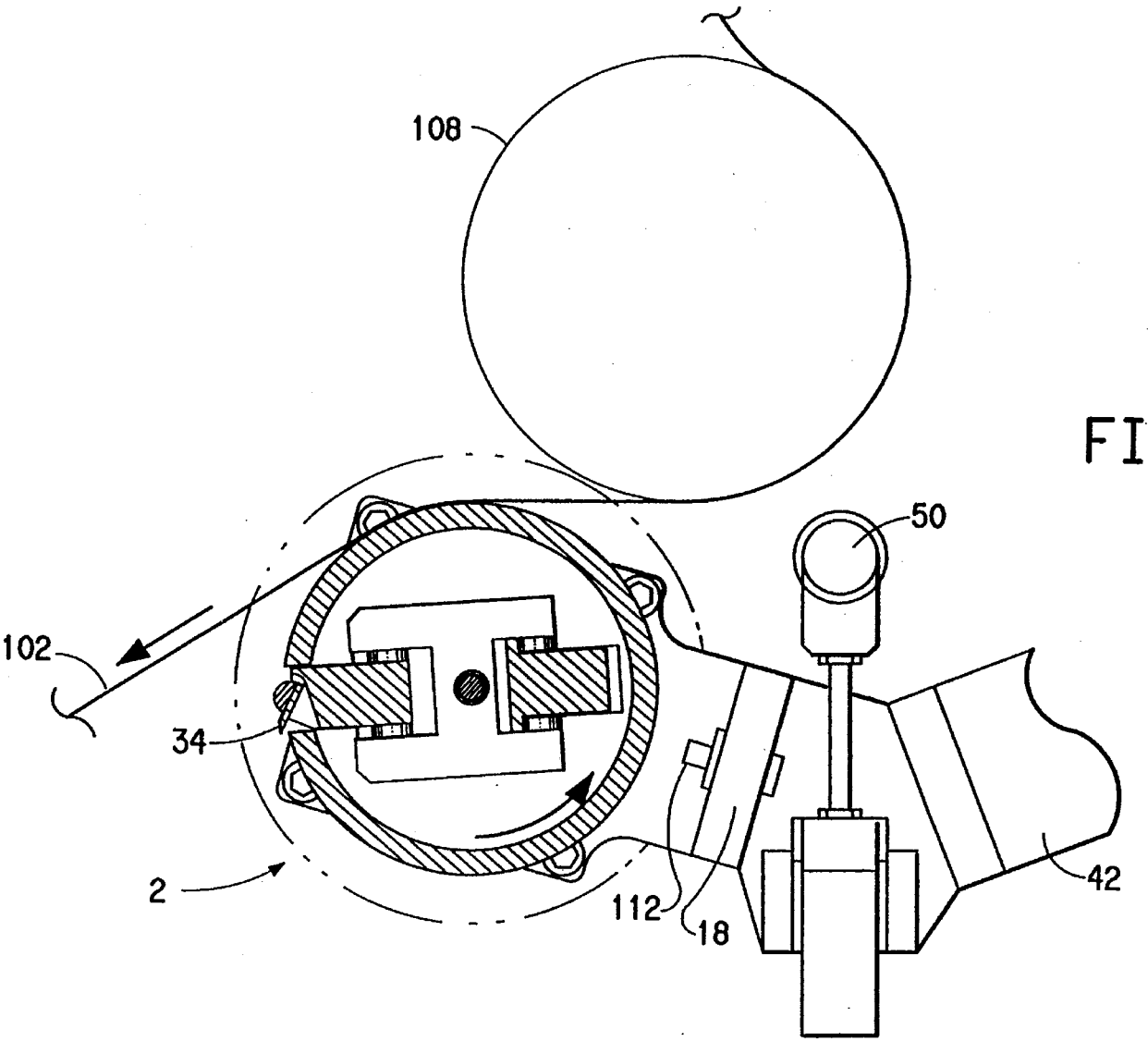
Figure 11C:
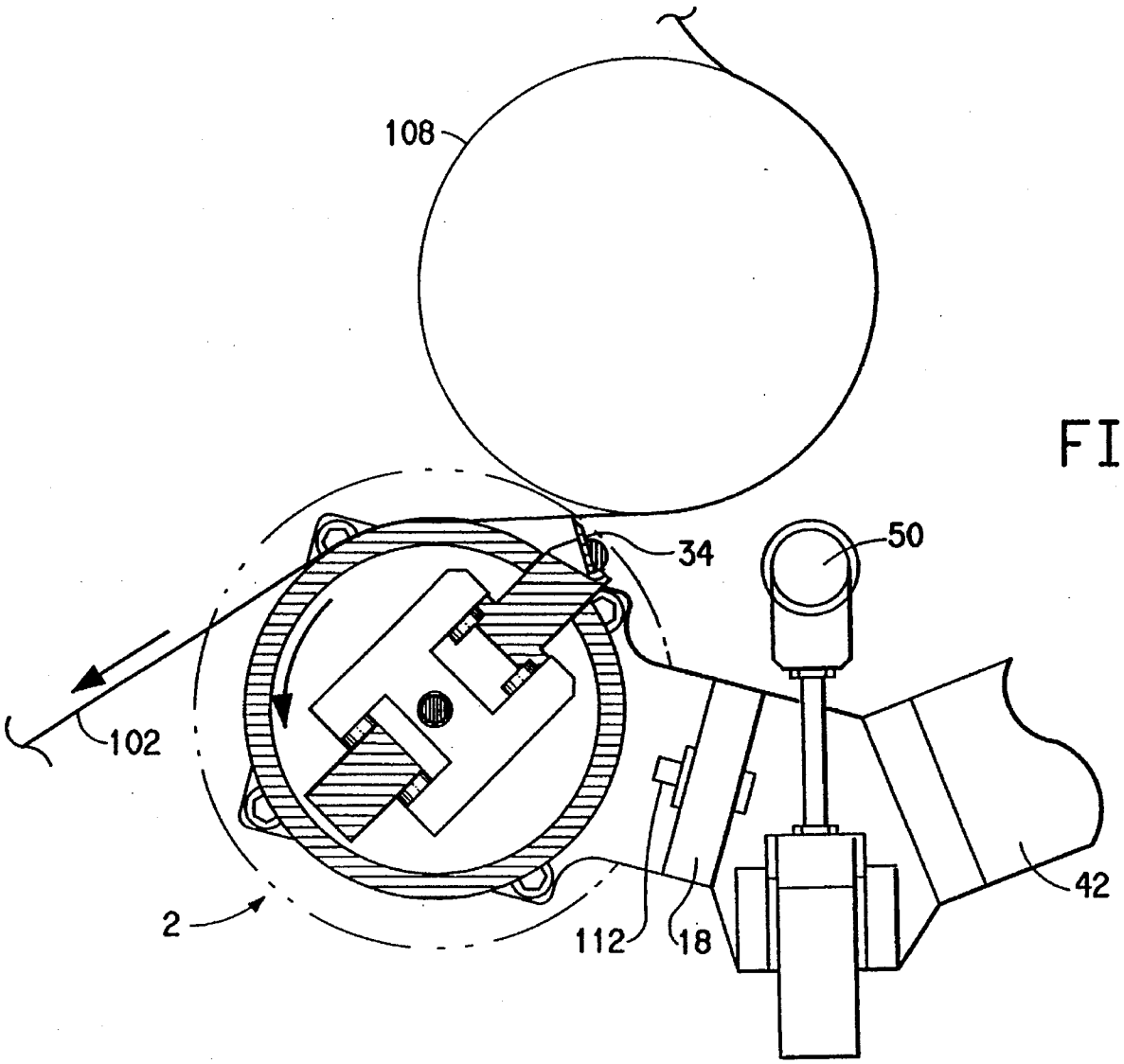

The lifting piston 46 of the lifting cylinder 48 lifts the arms 42, pivotally attached to the support frame 44, to a raised position. The static generator 50 is positioned adjacent to the core 108 as shown in FIGS. 11A, 11B and 11C. The static generator 50 is activated and generates static attraction between the film web 102 and the core 108. In the preferred embodiment, the static generator 50 generates about 10 kilovolts. The proximity sensor 112 senses the position and speed of the rotating cylindrical housing 2 by means of interaction between the sensor 112 and the flag 20. The sensor 112 generates a release signal in response to the flag 20 passing along a path adjacent to the sensor 112. The release signal is transmitted to the trigger mechanism 24. Responsive to the release signal, the trigger valve 36 activates the trigger cylinder 28 causing the trigger piston 30 to axially push the trigger shaft 32. Axial movement of the trigger shaft 32 pushes the triggers 68 causing the trigger rollers 94 to roll over the adjacent knife wings 82 and 84 and counterweight wings 90 and 92, respectively, thereby releasing the knife mount 56 and counterweight 54 when the trigger rollers 94 roll off the adjacent wing. Centrifugal force exerted on the knife mount 56 and the counterweight 54 due to the rotation speed of the cylindrical housing 2 causes the knife mount 56 and the counterweight 54 to move from the retracted position to the cutting position, thereby causing the knife 34 to move along a direction orthogonal to said longitudinal axis 4 through the aperture to a cutting position. The position of the sensor 112 is selected to ensure that the aperture 10 has passed the film web 102 prior to release of the knife 34. In FIG. 11A, the trigger mechanism 24 is engaged and the knife mount 56 and the counterweight 54 remain in the retracted position within the housing 2. In FIG. 11B, the triggers 68 have been released, and the cylindrical housing 2 has rotated while the knife 34 has moved from the retracted position towards the cutting position. In FIG. 11C, the knife 34 has stabilized in the cutting position. Further rotation of the cylindrical housing 2 with the knife 34 in the cutting position causes the knife 34 to sever the film web 102. In the preferred embodiment, the gap between the tip of the knife 34 and the core 108 is about 1.5 mm when the knife severs the film web. The incoming edge of the film web 102 is transferred onto the core 108 by means of the static attraction between the core 108 and the film web 102.

After the film web 102 is severed, the motor 38 smoothly decreases rotation of the cylindrical housing 2 to a stop. The cylindrical housing 2 is lowered to the rest position. When the centrifugal force exerted on the knife mount 56 and the counterweight 54 is decreased sufficiently, the springs 70 attached to the cylindrical shell 6 and connected to the knife mount 56 and the counterweight 54, respectively, pull the knife mount 56 and the counterweight 54 to the retracted position. The compression spring 76 adjacent to the one trunnion 12 returns the trigger shaft 32 to the retracted position such that the triggers 68 become engaged to hold the knife mount 56 and the counterweight 54 in the retracted position.

A preferred embodiment of the rotary knife apparatus 22 has utility for severing the film web 102 over a range of linear surface speeds of the cylindrical housing 2 between about 135 meters per minute, the lowest speed at which the knife 34 moves to the cutting position, to about 475 meters feet per minute, as limited by the motor 38. Automatic roll transfer using this rotary knife apparatus 22 has been demonstrated for polyester terephthalate film webs varying in thickness from about 10 to 33 microns. The distance between the core 108 and the incoming edge of the knife 34 when the knife 34 severed the film web 102 was about 1.5 mm. Examination of the film web 102 cut by the knife 34 shows a clean saw tooth cut trailing edge of the film web 102. This trailing edge transferred to the core 108 shows no bunching with a minimal amount of fold back or wrinkling of the film on the core 102 independent of film thickness. The amount of foldback averaged about 10 centimeters of web even when the rotary knife was used to sever film web 102 being wound at a linear speed of about 150 meters per minute.

What is claimed is:

1. An apparatus for cutting a film web comprising:

a cylindrical housing rotatably supported along a longitudinal axis thereof and connected to means for rotating the housing about said axis, said housing having an external surface with an aperture extending therethrough;

a knife movably supported by said housing so as to allow said knife to move along a direction orthogonal to said longitudinal axis through said aperture to a cutting position from a retracted position whereat said knife is held within said housing;

a counterweight movably supported by said housing so as to allow said counterweight to move in a direction substantially opposite to the movement of said knife from a retracted position adjacent said longitudinal axis to a cutting position away from said longitudinal axis; and means for releasing said knife and said counterweight from said retracted positions while said housing is rotating, and for moving said knife and said counterweight to said cutting positions by centrifugal force.

2. The apparatus of claim 1 wherein said cylindrical housing comprises a cylindrical shell attached at each end thereof to a trunnion, said trunnions being rotatably supported by two bearings affixed, respectively, to opposite ends of a support beam, and wherein said rotating means comprises a motor connected to one of said trunnions, said motor being supported by a motor mount affixed to one end of said support beam.

3. The apparatus of claim 2 wherein said knife is attached to a knife mount positioned in an upper half of said cylindrical shell along the direction of said longitudinal axis, said knife mount having tabs at each end thereof that project, respectively, into slots disposed in the adjacent trunnion and allow said knife to move in a direction away from said longitudinal axis to said cutting position.

4. The apparatus of claim 3 wherein said counterweight is positioned in the lower half of said cylindrical shell opposite said upper half along the direction of said longitudinal axis, said counterweight having projections at each end thereof that project, respectively, into grooves disposed in the adjacent trunnion along the same direction as said slots and allow said counterweight to move from said retracted position toward said shell when released.

5. The apparatus of claim 4 wherein said releasing means comprises an H-shaped trigger attached to a trigger shaft movably supported by said trunnions along said longitudinal axis, said trigger having two upward legs disposed in surrounding relationship to knife wings extending from opposite sides of said knife mount and having two downward legs disposed in surrounding relationship to counterweight wings extending from opposite sides of said counterweight, each of said legs having a trigger roller attached on the inside thereof and positioned so as to contact, respectively, the adjacent wing to hold said knife and counterweight in the retracted position, and to roll over the adjacent wing and release said knife and counterweight to the cutting position when said trigger shaft axially moves each trigger roller off the adjacent wing.

6. The apparatus of claim 5 wherein said releasing means further comprises a flag mounted on said shell adjacent said one trunnion, and a proximity sensor affixed to said support beam along the path of said flag when said shell is rotated, said proximity sensor generating a release signal in response to said flag passing by said sensor.

7. The apparatus of claim 6 wherein said releasing means further comprises a trigger block affixed to said support beam adjacent the other trunnion opposite said one trunnion, said trigger block supporting a trigger cylinder having a trigger piston disposed adjacent to said trigger shaft for axially pushing said shaft to release said knife from the retracted position, said trigger cylinder being activated by a trigger valve coupled to said proximity sensor for receiving said release signal.

8. The apparatus of claim 7 wherein said knife mount and said counterweight are connected to springs attached to said shell for pulling said knife mount and said counterweight back to the retracted position, and wherein said trigger shaft is connected to a compression spring adjacent said one trunnion for returning said shaft to the retracted position.

9. The apparatus of claim 8 wherein said support beam is attached to arms pivotally mounted on a support frame, and wherein said support beam is also attached to a lifting piston of a lifting cylinder affixed to said support frame for raising said cylindrical housing adjacent to said film web.

10. The apparatus of claim 9 further comprising a static generator affixed to said support beam and positioned so as to be adjacent said film web before cutting when said lifting cylinder has raised said cylindrical housing.

11. The apparatus of claim 1 wherein said knife comprises a blade oriented along a plane transverse to the direction of movement of said knife relative to said housing.

12. A method for cutting a film web comprising the steps of:

moving a rotating cylindrical housing adjacent to said film web, said cylindrical housing being rotatably supported along a longitudinal axis thereof and having an external surface with an aperture extending therethrough;

releasing a knife supported by said housing so as to allow said knife to move along a direction orthogonal to said longitudinal axis through said aperture to a cutting position from a retracted position whereat said knife is held within said housing;

releasing a counterweight supported by said housing so as to allow said counterweight to move in a direction substantially opposite to the movement of said knife from a retracted position adjacent said longitudinal axis to a cutting position away from said longitudinal axis: and moving said knife and said counterweight to said cutting positions by centrifugal force.

13. The method of claim 12 wherein said cylindrical housing comprises a cylindrical shell attached at each end thereof to a trunnion, said trunnions being rotatably supported by two bearings affixed, respectively, to opposite ends of a support beam, and wherein the rotating of said housing is performed by connecting a motor to one of said trunnions, said motor being supported by a motor mount affixed to one end of said support beam.

14. The method of claim 13 wherein said knife is attached to a knife mount positioned in an upper half of said cylindrical shell along the direction of said longitudinal axis, said knife mount having tabs at each end thereof that project, respectively, into slots disposed in the adjacent trunnion and allow said knife to move in a direction away from said longitudinal axis to said cutting position.

15. The method of claim 14 wherein said counterweight is positioned in the lower half of said cylindrical shell opposite said upper half along the direction of said longitudinal axis, said counterweight having projections at each end thereof that project, respectively, into grooves disposed in the adjacent trunnion along the same direction as said slots and allow said counterweight to move from said retracted position toward said shell when released.

16. The method of claim 15 wherein an H-shaped trigger is attached to a trigger shaft movably supported by said trunnions along said longitudinal axis, said trigger having two upward legs disposed in surrounding relationship to knife wings extending from opposite sides of said knife mount and having two downward legs disposed in surrounding relationship to counterweight wings extending from opposite sides of said counterweight, each of said legs having a trigger roller attached on the inside thereof and positioned so as to contact, respectively, the adjacent wing to hold said knife and counterweight in the retracted position, and to roll over the adjacent wing and release said knife and counterweight to the cutting position when said trigger shaft axially moves each trigger roller off the adjacent wing.

17. The method of claim 16 wherein said releasing step is performed by mounting a flag on said shell adjacent said one trunnion, affixing a proximity sensor to said support beam along the path of said flag on said rotating shell, and generating a release signal from said proximity sensor in response to said flag passing by said sensor.

18. The method of claim 17 wherein a trigger block is affixed to said support beam adjacent the other trunnion opposite said one trunnion, said trigger block supporting a trigger cylinder having a trigger piston disposed adjacent to said trigger shaft for axially pushing said shaft to release said knife from the retracted position, and wherein said releasing step further comprises sending said release signal from said proximity sensor to a trigger valve for activating said trigger cylinder, thereby causing said trigger piston to axially push said shaft and release said knife from the retracted position.

19. The method of claim 18 wherein said knife mount and said counterweight are connected to springs attached to said shell for pulling said knife mount and said counterweight back to the retracted position, and wherein said trigger shaft is connected to a compression spring adjacent said one trunnion for returning said shaft to the retracted position.

20. The method of claim 19 wherein said support beam is attached to arms pivotally mounted on a support frame, wherein said support beam is also attached to a lifting piston of a lifting cylinder affixed to said support frame, and wherein said moving step is performed by activating the lifting piston of said lifting cylinder so as to raise said cylindrical housing adjacent to said film web.

21. The method of claim 12 wherein said film web is being wound on a film roll and wherein said method further comprises the steps of:

rotating a new core into contact with said film web and positioning a static generator adjacent said new core prior to said moving step; and activating said static generator prior to said releasing step so as to generate a static attraction between the film web and the new core, said moving step being performed by moving said rotating cylindrical housing adjacent the film web between the film roll and the new core.

* * * * *